US005217487A

United States Patent [19]

Engel et al.

[11] Patent Number: 5,217,487

[45] Date of Patent: Jun. 8, 1993

[54] BACK THERAPY SYSTEM

[75] Inventors: Timothy S. Engel, Mound, Minn.; Dennis J. Colonello, Studio City, Calif.; Weston L. Cutter, Mendota Heights; Stephen S. Peterson, Maple Grove, both of Minn.

[73] Assignee: NordicTrack, Inc., Chaska, Minn.

[21] Appl. No.: 736,009

[22] Filed: Jul. 25, 1991

[51] Int. Cl.[5] ..... A61H 1/02

[52] U.S. Cl. ..... 606/240; 606/244; 482/142; 482/907; 5/613; 5/618; 5/624

[58] Field of Search ..... 606/240–245; 5/601, 613, 614, 618, 620, 624; 482/142, 906, 907

[56] References Cited

U.S. PATENT DOCUMENTS

| | | | |
|---|---|---|---|
| 2,228,793 | 1/1941 | Swofford | 5/613 X |
| 2,644,688 | 7/1953 | Roberge | 482/142 X |
| 3,378,259 | 4/1968 | Kupchinski . | |
| 3,491,385 | 1/1970 | Werner | 606/242 X |
| 3,709,487 | 1/1973 | Walker | 482/142 X |
| 3,889,664 | 6/1975 | Heuser et al. . | |
| 4,030,489 | 6/1977 | Buckner . | |
| 4,292,962 | 10/1981 | Krause | 482/142 X |
| 4,372,553 | 2/1983 | Hatfield . | |
| 4,566,693 | 1/1986 | Seidentop . | |
| 4,583,731 | 4/1986 | Crivello . | |
| 4,606,332 | 8/1986 | Gibson . | |
| 4,609,193 | 9/1986 | Paris et al. | 482/142 X |
| 4,611,806 | 9/1986 | Terry | 482/142 |
| 4,638,995 | 1/1987 | Wilson . | |
| 4,678,187 | 7/1987 | Prsala . | |
| 4,753,438 | 6/1988 | Paris et al. . | |
| 4,830,367 | 5/1989 | Foran . | |
| 4,836,536 | 6/1989 | Jones . | |
| 4,867,142 | 9/1989 | Jones | 482/907 X |
| 4,867,143 | 9/1989 | Morin . | |
| 4,893,813 | 1/1990 | Murray et al. . | |
| 4,905,330 | 3/1990 | Jacobs . | |
| 4,927,139 | 5/1990 | Taltre . | |
| 5,050,589 | 9/1991 | Engle | 606/242 X |

FOREIGN PATENT DOCUMENTS

| | | | |
|---|---|---|---|
| 1291572 | 9/1962 | France | 269/328 |

*Primary Examiner*—Randall L. Green
*Assistant Examiner*—Mary Beth O. Jones

[57] ABSTRACT

The present invention provides an apparatus 100 of a type on which a person 190 receives back therapy. The apparatus 100 includes a frame 101 designed to rest upon a floor surface 109. A support member 102 is pivotally mounted to the frame 101 above the floor surface 109, and a pelvic belt 103 is secured relative to the support member 102. In operation, the pelvic belt 103 stabilizes the person's pelvis relative to the support member 102, and the support member supports some portion of the person's torso including the pelvis. The support member 102 pivots among several positions, including a mounting position suitable for mounting by a person, and a locking mechanism 104 secures the support member 102 in any of a plurality of back therapy positions.

8 Claims, 9 Drawing Sheets

BACK THERAPY SYSTEM

FIELD OF THE INVENTION

The present invention relates generally to back therapy apparatus, and more particularly, to a multi-purpose back therapy apparatus designed to facilitate flexion distraction maneuvers, McKenzie extension exercises, Williams flexion exercises, and inversion therapy.

BACKGROUND OF THE INVENTION

Back troubles are an unfortunate fact of life for millions of people. In response to this commonplace problem, numerous treatments have been developed, recommended, and practiced. Among the most effective back therapy protocols are flexion distraction maneuvers, McKenzie extension exercises, Williams flexion exercises, and inversion therapy, each of which is facilitated by therapy equipment particularly designed for such purpose.

Generally speaking, flexion distraction maneuvers are used to stretch out the posterior compartments of the lumbar spine and its myofascial components in the coronal, sagittal, and transverse planes of motion. McKenzie extension exercises are recommended for patients with sedentary lifestyles and for persons involved in excessive forward bending and lifting at the thoracolumbar junction. Williams flexion exercises are prescribed for patients requiring flexion distraction maneuvers to strengthen the abdominal wall. When used in conjunction with pelvic stabilization, inversion therapy employs the weight of the upper body for safer application of passive traction without stress to any other joints. The present invention provides a back therapy apparatus that facilitates all four such protocols.

SUMMARY OF THE INVENTION

The present invention provides an apparatus of a type on which a person receives back therapy. The apparatus includes a rigid frame designed to rest upon a floor surface; a supporting means, pivotally mounted to the frame above the floor surface, for supporting the person's pelvis and upper body; a pelvic stabilization means, secured relative to the supporting means, for stabilizing the person's pelvis relative to the supporting means; and a support locking means, operatively connected to the supporting means, for locking the supporting means in any one of a plurality of positions. The supporting means pivots from a mounting position suitable for mounting by the person; to a first operable position suitable for flexion distraction maneuvers; to a second operable position suitable for McKenzie extension exercises; to a third operable position suitable for Williams flexion exercises; and to a fourth operable position suitable for inversion therapy.

According to a preferred embodiment of the present invention, the frame includes (1) a base member having a front end and a rear end and designed to rest upon a floor surface; (2) an intermediate support member extending up from the floor surface and to which the supporting means is pivotally mounted; (3) a first elevation foot support extending up from the floor surface proximate the rear end; and (4) a second elevation foot support extending up from the floor surface proximate the rear end. The supporting means is also rotatably mounted to the frame, and thus, is capable of rotating out of its plane of pivoting. As a result, the supporting means is accessible for mounting by persons who are otherwise unable to mount the supporting means due to handicap or excessive size, which prevents access between the supporting means and the foot supports.

The supporting means includes a pad member having a contoured, person engaging surface characterized by a substantially rounded first segment joined to a substantially flat second segment joined to a substantially flat third segment. The first segment faces away from the second segment, and the second segment faces away from the third segment. The surface is symmetrical about its longitudinal axis, and the surface is interrupted by a longitudinally oriented void. When in the mounting position, the surface faces substantially toward the rear end, and the first segment is between the intermediate support member and the rear end. The pelvic stabilization means includes a strap member secured to the pad member behind the first segment.

The first elevation foot support and the supporting means are spatially positioned relative to one another such that when the person's pelvis is stabilized relative to the supporting means and he supporting means is pivoted to and locked in the second operable position, the first elevation foot support provides support for the feet of the person performing McKenzie extension exercises. The second elevation foot support and the supporting means are spatially positioned relative to one another such that when the pelvis of the person is stabilized relative to the supporting means and the supporting means is pivoted to and locked in the third operable position, the second elevation foot support provides support for the feet of the person performing Williams flexion exercises. Also, when the supporting means is pivoted to and locked in the fourth operable position, the second elevation foot support provides support for the feet of the person undergoing inversion therapy.

In connection with McKenzie extension exercises, the apparatus may additionally include (1) segmental isolation means, secured relative to the supporting means, for isolating a particular segment of the person's back by stabilizing that portion of the person's back immediately below the particular segment to be isolated; and (2) an isotonic exercise device, secured to the frame proximate the front end, and designed to be operated by the person pivoted to and locked in the second operable position.

The present invention provides several advantages. For example, the present invention provides a single, relatively compact and inexpensive piece of equipment that is suitable for four different back therapy protocols: flexion distraction maneuvers; McKenzie extension exercises; Williams flexion exercises; and inversion therapy. In addition to versatility, the present invention also offers flexibility with respect to patients' particular physical status and therapy needs. Persons of various sizes and having various needs can be comfortably and effectively positioned on the pad member, which can then be maneuvered to a desired position. Once an ideal position is achieved, the position is locked in place by simply turning a knob, at which point the therapist is completely free to administer therapy to the patient.

The present invention also provides a safer and more effective therapy system. By unloading the spine while stretching and relaxing the back, specific muscle groups can be more readily isolated for more effective therapy. Also, the use of the pelvic stabilization belt reduces stress on inflamed joints, allowing inversion therapy at a variety of angles to provide passive, progressive resistance. The availability of a segmental isolation strap and an isotonic exercise device provide the therapist with additional options for more aggressive approaches to treatment. These and other advantages will become apparent to those skilled in the art upon a more detailed description of a preferred embodiment of the present invention.

BRIEF DESCRIPTION OF THE DRAWING

Referring to the Figures, which are drawn to scale and wherein like numerals represent like parts throughout the several views.

DETAILED DESCRIPTION OF A PREFERRED EMBODIMENT

Figure 1:
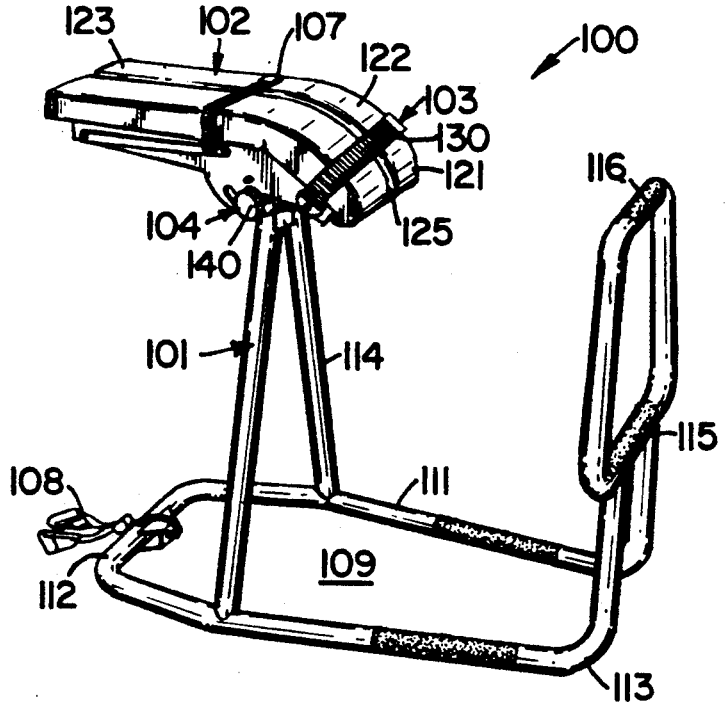
FIG. 1 is a perspective view of a preferred embodiment of the back therapy apparatus of the present invention.
Figure 9:
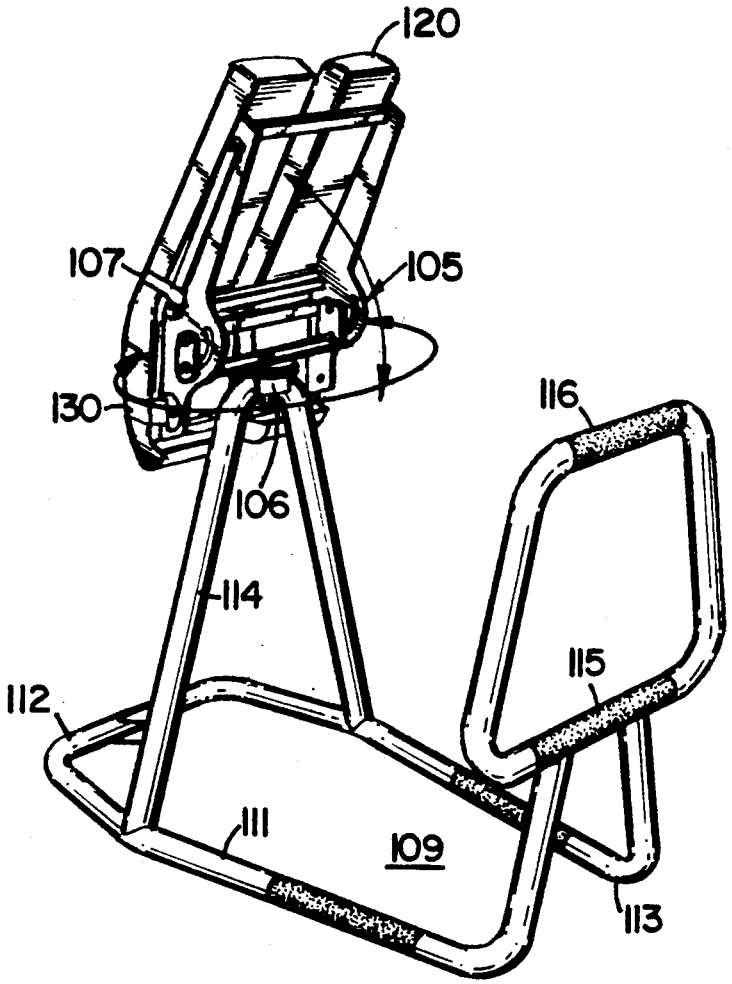
FIG. 9 is a perspective view of the preferred embodiment of the back therapy apparatus of FIG. 1 in a second mounting position.

Referring to FIG. 1, a preferred embodiment of a back therapy apparatus constructed according to the principles of the present invention is designated generally at 100. The apparatus 100 includes a rigid frame 101; a supporting means 102 for supporting a person at the pelvis and upper body; a pelvic stabilization means 103 for stabilizing the person's pelvis relative to the supporting means 102; and a support locking means 104 for locking the supporting means 102 in any one of a plurality of positions. The frame 101 is designed to rest upon a floor surface 109, and the supporting means 102 is pivotally and rotatably mounted to the frame 101 above the floor surface 109. As shown in FIG. 9, conventional pivoting means 105 and rotating means 106 allow the supporting means 102 to pivot and rotate, respectively, relative to the frame 101. The pelvis stabilization means 103 is secured relative to the supporting means 102, and the support locking means 104 is operatively connected to the supporting means 102.

Figure 8:
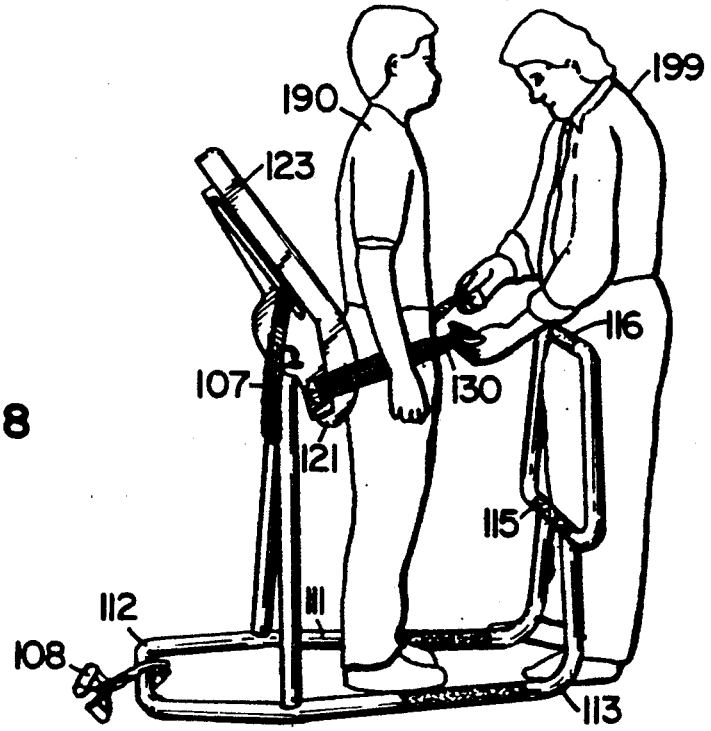
FIG. 8 is a perspective view of the preferred embodiment of the back therapy apparatus of FIG. 1 in a first mounting position.
Figure 2:
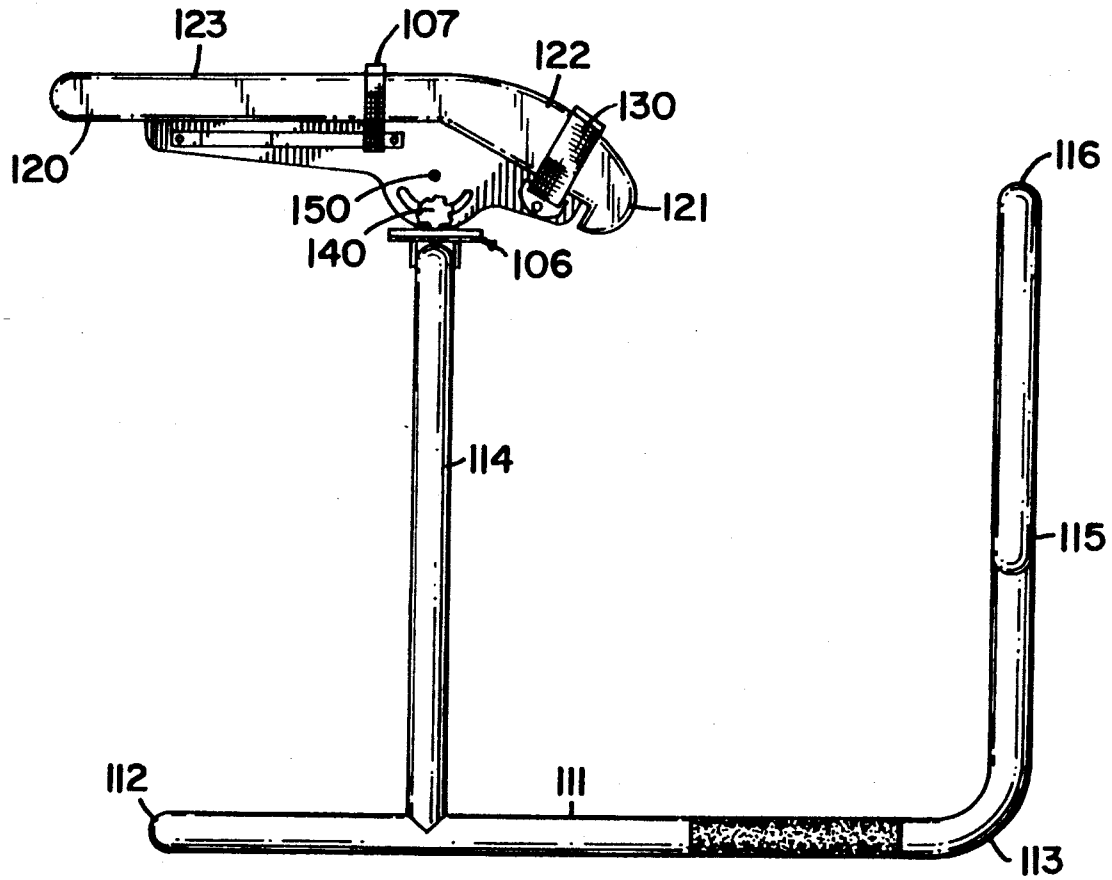
FIG. 2 is a right side view of the preferred embodiment of the back therapy apparatus of FIG. 1.
Figure 3:
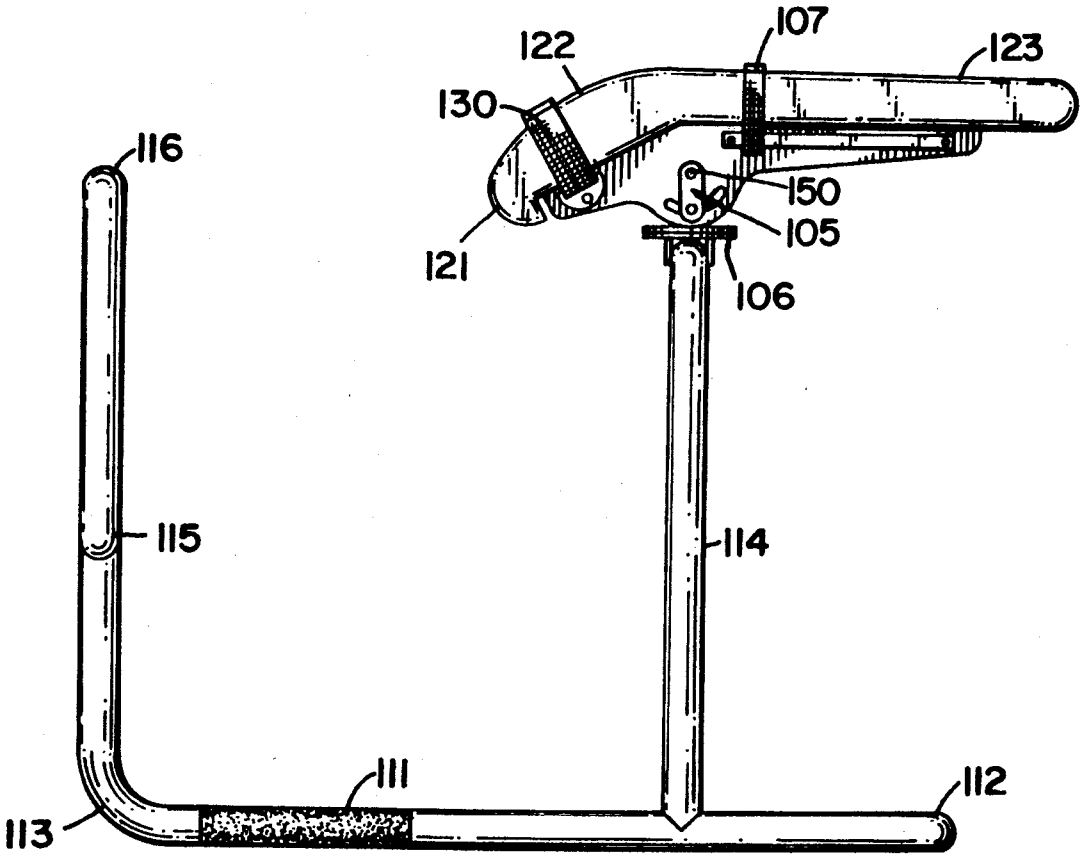
FIG. 3 is a left side view of the preferred embodiment of the back therapy apparatus of FIG. 1.
Figure 5:
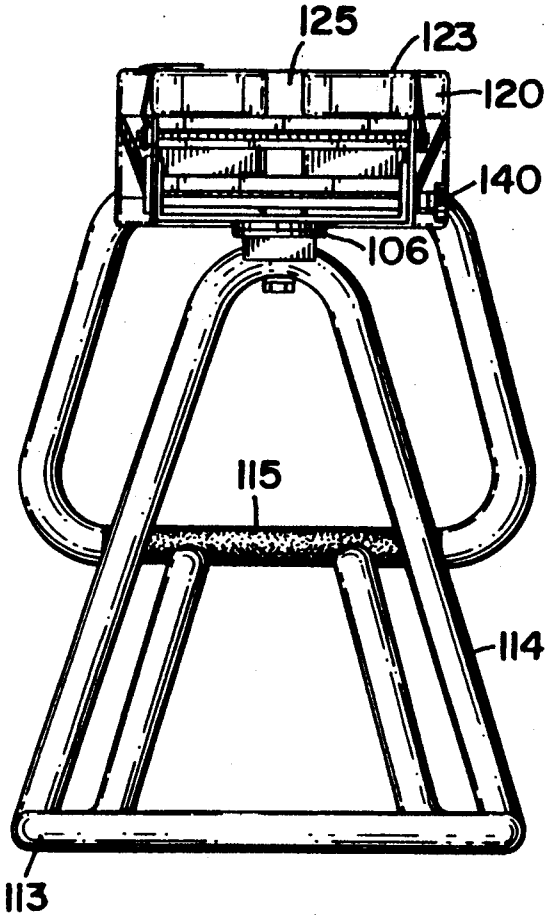
FIG. 5 is a rear view of the preferred embodiment of the back therapy apparatus of FIG. 1.
Figure 4:
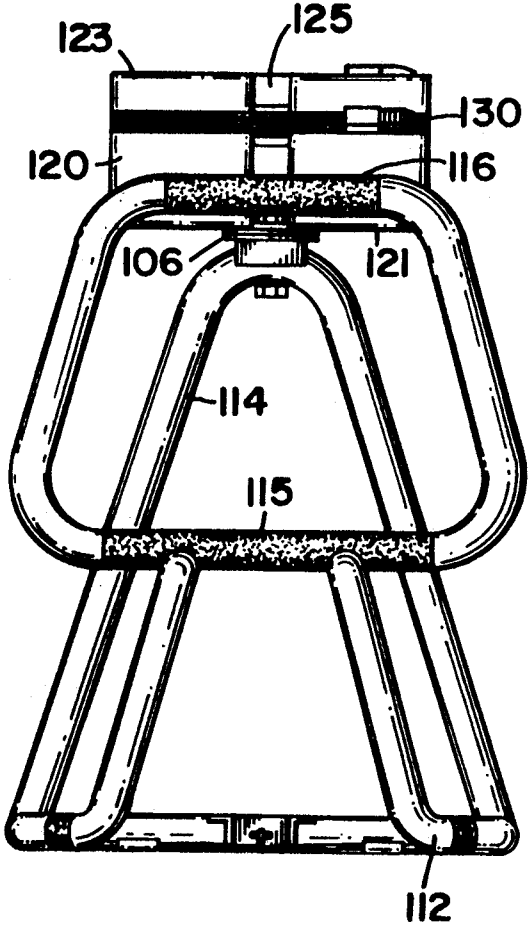
FIG. 4 is a front view of the preferred embodiment of the back therapy apparatus of FIG. 1.
Figure 10:
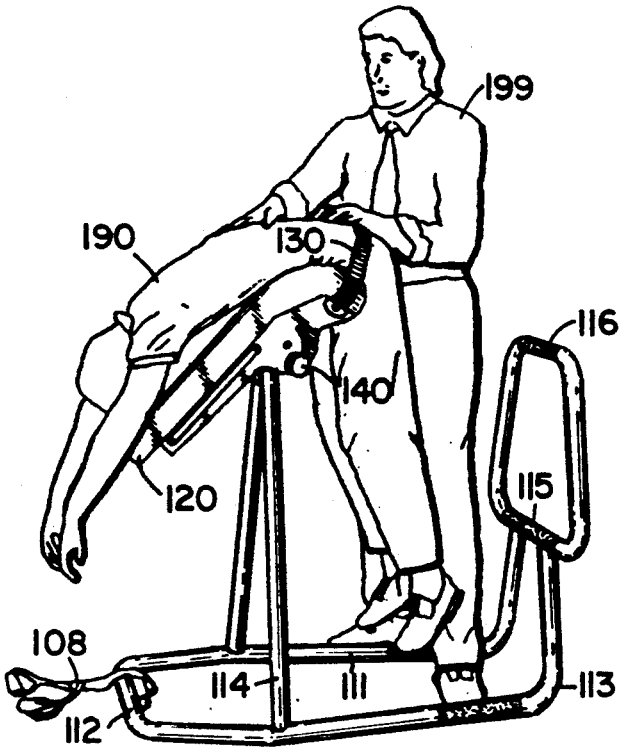
FIG. 10 is a perspective view of the preferred embodiment of the back therapy apparatus of FIG. 1 in a first operable configuration suitable for flexion distraction maneuvers, having been mounted by a patient who is attended by a therapist.
Figure 11:
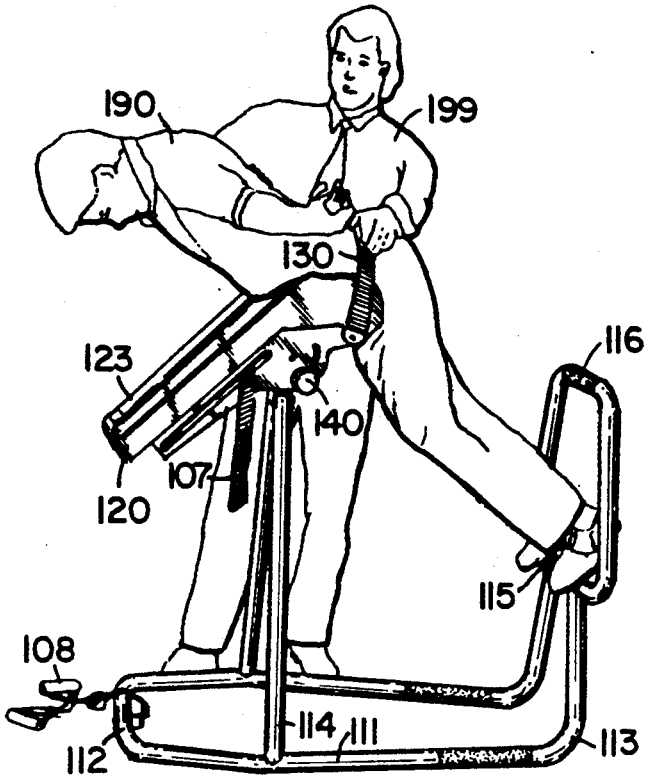
FIG. 11 is a perspective view of the preferred embodiment of the back therapy apparatus of FIG. 1 in a second operable configuration suitable for McKenzie extension exercises, having been mounted by a patient who is attended by a therapist.
Figure 12:
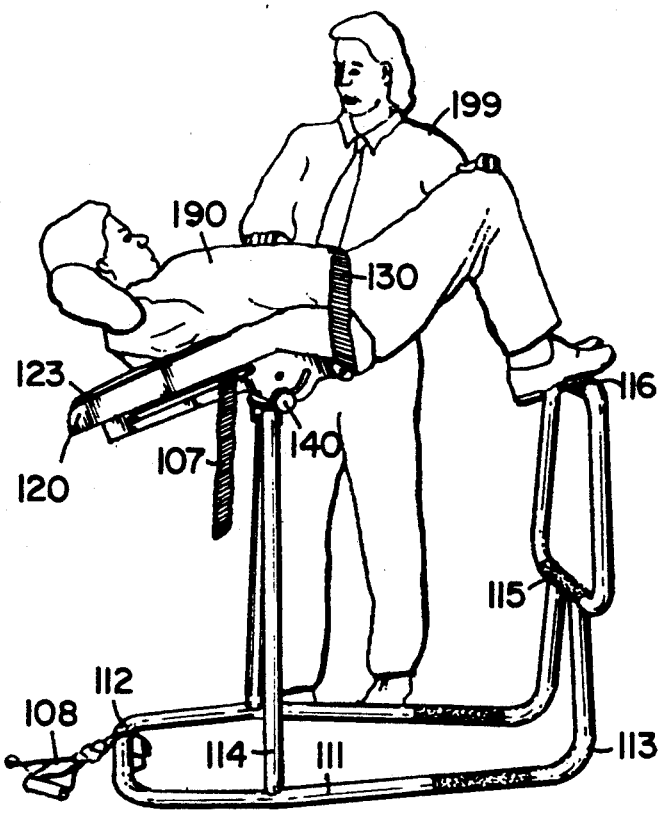
FIG. 12 is a perspective view of the preferred embodiment of the back therapy apparatus of FIG. 1 in a third operable position suitable for Williams flexion exercises, having been mounted by a patient who is attended by a therapist.
Figure 13:
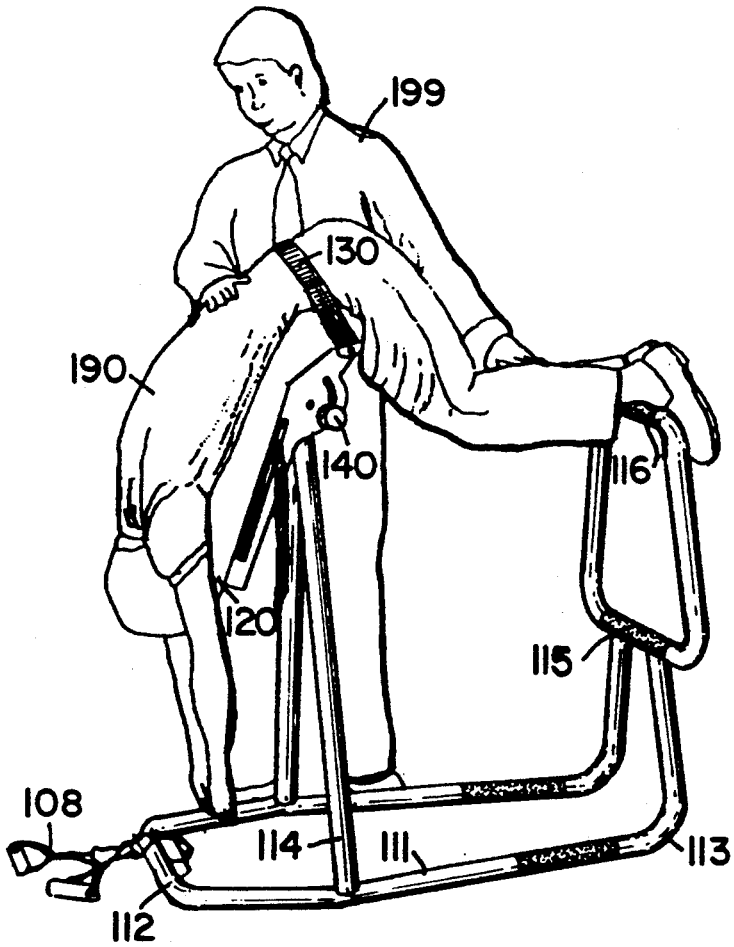
FIG. 13 is a perspective view of the preferred embodiment of the back therapy apparatus of FIG. 1 in a fourth operable position suitable for inversion therapy, having been mounted by a patient who is attended by a therapist.

The supporting means 102 pivots among a plurality of positions, including a mounting position suitable for mounting by the person, as shown in FIGS. 8 and 9; a first operable position suitable for flexion distraction maneuvers, as shown in FIG. 10; a second operable position suitable for McKenzie extension exercises, as shown in FIG. 11; a third operable position suitable for Williams flexion exercises, as shown in FIG. 12; and a fourth operable position suitable for inversion therapy, as shown in FIG. 13. Rotation of knob 140, which forms a part of the support locking means 104, in a first direction "locks" the supporting means 102 in any one of the plurality of positions, and rotation of knob 140 in the opposite direction releases the supporting means 102.

According to a preferred embodiment of the present invention, the frame 101 is constructed of two inch steel tubing. Referring to FIGS. 1 through 7, the frame 101 includes (1) a base member 111 having a front end 112 and a rear end 113 and designed to rest upon the floor surface 109; (2) an intermediate support member 114 extending up from the floor surface 109 and to which the supporting means 102 is pivotally and rotatably mounted; (3) a first elevation foot support 115 extending up from the floor surface 109 proximate the rear end 113; and (4) a second elevation foot support 116 extending up from the floor surface 109 proximate the rear end 113.

The base member 111 is substantially planar, such that when the apparatus 100 is an operable orientation, the base member 111 defines a substantially horizontal plane parallel to the floor surface 109. The intermediate support member 114 defines a plane that is substantially perpendicular to the plane defined by the base member 116. Similarly, the foot supports 115 and 116 define a plane that is substantially perpendicular to the plane defined by the base member 111, and parallel to that of the intermediate support member 114. Thus, relative to the base member 111, the intermediate support member 114 may be said to be an intermediate upright member, and the structure defining the foot supports 115 and 116 may be said to be a rear upright member. The plane of pivoting defined by the pivoting of the pad member 120 is perpendicular to all three of the above-mentioned planes.

The first elevation foot support 115 and the supporting means 102 are spatially positioned relative to one another such that when the person's pelvis is stabilized relative to the supporting means 102 and the supporting means 102 is pivoted to and locked in the second operable position, the first elevation foot support 115 provides support for the feet of the person 190 performing McKenzie extension exercises, as shown in FIG. 11. The second elevation foot support 116 and the supporting means 102 are spatially positioned relative to one another such that when the person's pelvis is stabilized relative to the supporting means 102 and the supporting means 102 is pivoted to and locked in the third operable position, the second elevation foot support 116 provides support for the feet of the person performing Williams flexion exercises, as shown in FIG. 12. Also, the second elevation foot support 116 and the supporting means 102 are spatially positioned relative to one another such that when the person's pelvis is stabilized relative to the supporting means 102 and the supporting means 102 is pivoted to and locked in the fourth operable position, the second elevation foot support 116 provides support for the feet of the person receiving inversion therapy, as shown in FIG. 13. The foot supports 115 and 116 also provide a convenient support for stretching exercises prior to mounting the supporting means 102.

Figure 7:
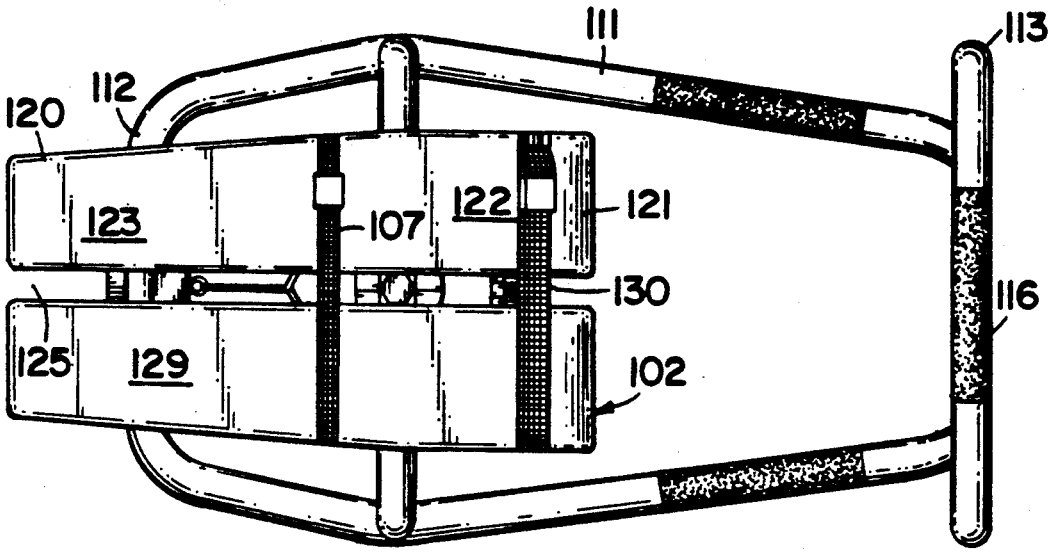
FIG. 7 is a top view of the preferred embodiment of the back therapy apparatus of FIG. 1.
Figure 6:
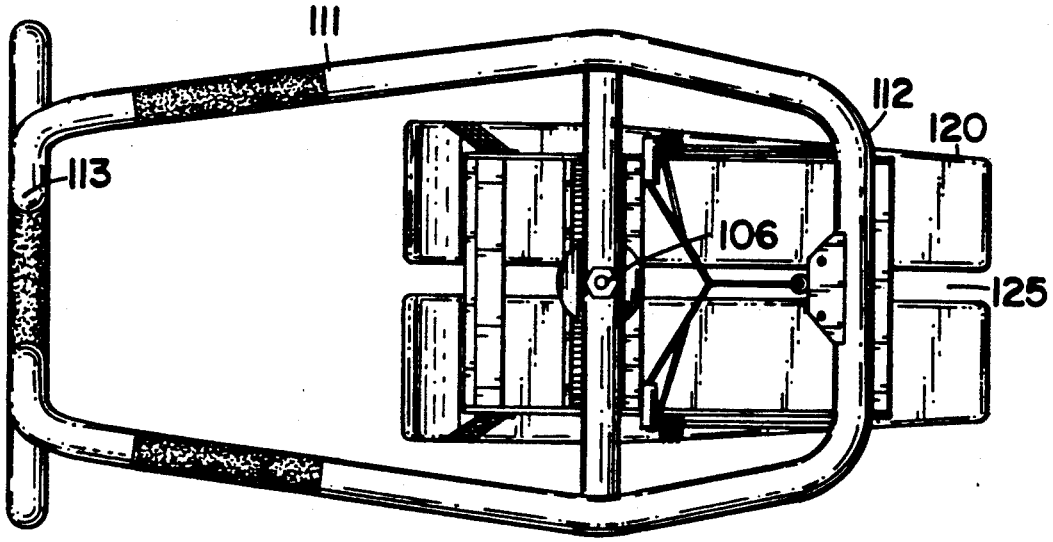
FIG. 6 is a bottom view of the preferred embodiment of the back therapy apparatus of FIG. 1.

Referring to FIGS. 1 and 7, the supporting means 102 includes a pad member 120 having a contoured, person engaging surface 129 characterized by a substantially rounded first segment 121 joined to a substantially flat second segment 122 joined to a substantially flat third segment 123. The surface 129 is defined by the outer surface of a self-skinning, high density polyurethane foam, which is mounted to a more rigid substructure. The first segment 121 faces away from the second segment 122, and the second segment 122 faces away from the third segment 123. The contour 129 of the pad member 120 is designed to provide comfort and necessary support for the patient's pelvis and upper body throughout the plurality of positions and the ranges of patient movement in each position. The surface 129 is symmetrical about its longitudinal axis, as shown in FIG. 7, and the surface 129 is interrupted by a longitudinally oriented void 125. The void 125 provides breathing space for the patient when facing the pad member 120 during flexion distraction maneuvers, McKenzie extension exercises, and inversion therapy, and the void 125 provides clearance for the spine of the patient when lying back against the pad member 120 during Williams flexion exercises.

When the pad member 120 is pivoted to the mounting position, as shown in FIG. 8, the surface 129 faces substantially toward the rear end 113, and the first segment 121 is between the intermediate support member 114 and the rear end 113. The patient approaches the pad member 120 from the rear end side and presses up against the first segment 121 and leans over the second segment 122 and the third segment 123. A strap member 130, which is secured to the pad member 120 behind the first segment 121, is fastened about the patient's buttocks or waist (depending on the specific protocol) to stabilize the person's pelvis relative to the pad member 120. Because the patient is standing behind the pivot point 150 (shown in FIGS. 2 and 3) of the pad member 120, the patient is lifted from the floor surface 109 as the pad member 120 is pivoted forward. The rounded configuration of the first segment 121 is well suited to engage the base of the patient's torso and roll the patient off the floor surface and about the pivot point 150. When the pad member 120 is pivoted to the desired position, the support locking means 104 is engaged to releasably retain the pad member 120 in the desired position. At this point the patient is in the desired position, and the therapist's hands are free to administer therapy and/or make any necessary adjustments.

As shown in FIG. 9, the supporting means 102 is also rotatably mounted to the frame 101, such that the supporting means 102 is capable of rotating out of its plane of pivoting about an axis perpendicular to the floor surface 109. Thus, where the proximity of the foot supports 115 an 116 to the pad member 120 makes it difficult to mount the pad member 120, as may be the case with certain handicapped and/or very large persons, the pad member 120 may be rotated to a more accessible orientation, as shown in FIG. 9.

When the supporting means 102 is locked in the first operable position, the apparatus 100 is suitable for flexion distraction maneuvers, as shown in FIG. 10. Those skilled in the art will recognize that flexion distraction maneuvers are used to stretch out the posterior compartments of the lumbar spine and its myofascial components in the coronal, sagittal, and transverse planes of motion. The patient 190 faces the pad member 120 and leans up against it, and the patient's pelvis is stabilized by the fastening of the strap member 130 about the patient's buttocks. Upon pivoting of the pad member 120 to the first position, the person's legs hang off the pad member 120, extended at the knee and flexed at the hip. Typically, the therapist 199 then stands to the rear of the patient 190 with one hand on the patient's lumbar area and the opposite thigh and knee at the patient posterior thigh and calf area. The therapist 199 then gently applies superficial traction towards the patient's head with a hand on the lumbar while the patient attempts to lift his legs into extension at the hip against the therapist's resisting force. The lumbar extensor will attempt to contract against the therapist's manual traction in the direction of the head. Repetition of this thoraco-lumbar transition, one segment at a time, effectively stretches out the posterior vertebral and sacro-iliac compartments and is very effective in acute-care management.

When the supporting means 102 is locked in the second operable position, the apparatus 100 is suitable for McKenzie extension exercises, as shown in FIG. 11. Those skilled in the art will recognize that McKenzie extension exercises are useful for patients with sedentary lifestyles and persons involved in excessive forward bending and lifting at the thoraco-lumbar injunction. Again, the patient 190 faces the pad member 120 and leans up against it, and the patient's pelvis is stabilized by the fastening of the strap member 130 about the patient's buttocks. Following pivoting of the pad member 120 to the second position, the patient's feet may rest on either foot support 115 or 116, depending on the flexibility of the hamstrings. The patient 190 is then typically instructed to extend straight upwards, hands behind back, chin tucked or in a neutral position. By either increasing the range of motion or adjusting the variable inclination of the supporting means, progressive resistance is provided to flexion subluxation of the lower thoracic segments on the extended upper lumbar segments.

Figure 14:
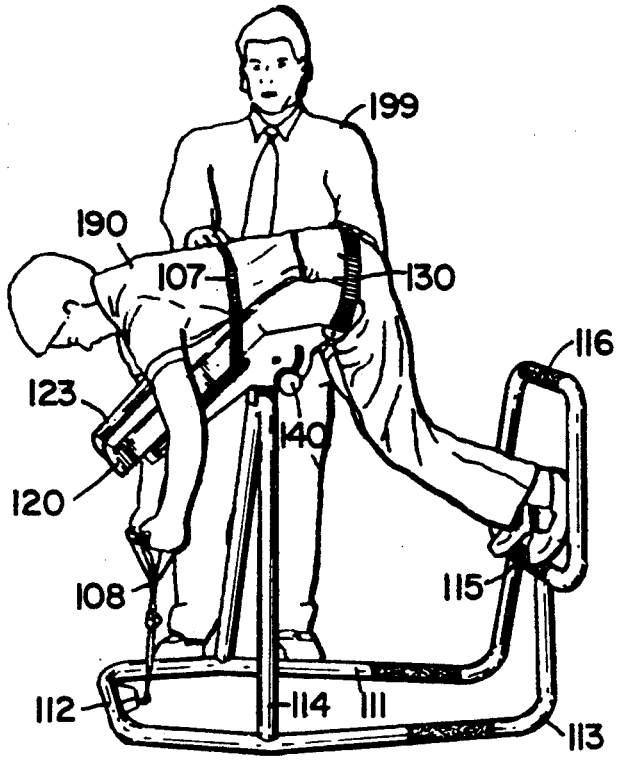
FIG. 14 is a perspective view of the preferred embodiment of the back therapy apparatus of FIG. 11 in the second operable position suitable for McKenzie extension exercises, having been mounted by a patient who is attended by a therapist, and with the patient performing isotonic exercises.

In connection with the McKenzie extension exercises, the apparatus 100 may additionally include (1) segmental isolation means 107, secured relative to the supporting means 102, for isolating a particular segment of the person's back by stabilizing that portion of the person's back immediately below the particular segment to be isolated; and (2) an isotonic exercise device 108, secured to the frame 101 proximate the front end 112, and designed to be operated by the person pivoted to and locked in the second operable position. Appropriate localization of the strap member that provides the segmental isolation means 107 below the involved segment permits more accurate mobilization of the involved segment in the sagittal plane of extension. Additionally, patient operation of the isotonic exercise device 108, as demonstrated in FIG. 14, produces an enhanced effect on the affected segments. The isotonic exercise device 108 includes a pair of handles secured to heavy duty rubber bands, which are in turn secured to the front end 112 of the frame 101.

When the supporting means 102 is locked in the third operable position, the apparatus 100 is suitable for Williams flexion exercises, as shown in FIG. 12. Those skilled in the art will recognize that Williams flexion exercises are typically prescribed for patients requiring the flexion distraction maneuvers to strengthen the abdominal wall. Contrary to the other treatment protocols, the patient 190 approaches the pad member 120 with the buttocks placed against the pad member 120. The pelvic locking strap member 130 is then secured about the patient's waist to prevent pelvic rotation and to isolate abdominal muscle activation. Upon pivoting of the pad member 120 to the third position, the patient 190 can place one foot on the lower foot support 115 to move into the desired exercise position. In performing Williams flexion exercises, the patient lies back onto the pad member 120, places the feet on the foot supports 115 and 116, and places hands by the ears, and then gently raises and lowers the shoulders off and back to the support pad 120 to and from the point of flexion desired. The support pad 120 should be angled to support the thoraco-lumbar transition and allow for slight extension of the upper torso, thereby providing a prestretch of the abdominal at the onset and completion of the exercise. Progressive resistance is afforded by tipping the body support pad into progressive inversion, thereby increasing the distribution of the body weight superiorly.

When the supporting means 102 is locked in the fourth operable position, the apparatus 100 is suitable for inversion therapy, as shown in FIG. 13. Those skilled in the art will recognize that when used in conjunction with pelvic stabilization, inversion therapy employs the weight of the upper body for safer application of passive traction without stress to any other joints. Again, the patient 190 faces the pad member 120 and leans up against it, an the patient's pelvis is stabilized by the fastening of the strap member 130 about the patient's buttocks. Upon pivoting of the pad to the fourth position, constituting the desired angle of inversion, the patient's feet may be placed over the upper-rear support bar if necessary. At this point the therapist may provide additional traction assistance as needed.

While the present invention has been described in terms of a preferred embodiment, the scope of the present invention is to be limited only by the appended claims.

What is claimed is:

1. An apparatus on which a person receives back therapy, comprising:

a base having a front end and a rear end and designed to rest upon a floor surface;

an intermediate support extending up from said base;

a foot support extending up from said base proximate said rear end;

a supporting means, pivotally and rotatably mounted to said intermediate support, for supporting some portion of the person's torso including the pelvis, wherein said supporting means pivots among a plurality of positions, including a mounting position suitable for mounting by the person, and wherein said supporting means rotates out of its plane of pivoting, whereby said supporting means is accessible for mounting outside a confined space between said supporting means and said a pelvic stabilization means, secured relative to said supporting means, for stabilizing the person's pelvis relative to said supporting means; and a locking means, operatively connected to said supporting means, for locking said supporting means in any one of said plurality of positions.

2. An apparatus according to claim 1, wherein said supporting means includes a pad member having a contoured, person engaging surface characterized by a substantially rounded first segment joined to a substantially flat second segment joined to a substantially flat third segment, with said first segment facing away from said second segment, said second segment facing away from said third segment.

3. An apparatus according to claim 2, wherein said pelvic stabilization means includes a strap member secured to said pad member behind said first segment.

4. An apparatus on which a person receives back therapy, comprising:

a base member having a front end and a rear end and designed to rest upon a floor surface;

an intermediate support member, extending up from said base member;

a pad member having a substantially rounded, first end and a substantially flat, second end, wherein said pad member is pivotally mounted to said intermediate support member to pivot among a plurality of positions in such a manner that when in a mounting position, said first end is between said intermediate support member and said rear end;

a pelvic stabilization means, secured relative to said pad member, for stabilizing the person's pelvis relative to said pad member;

a first elevation foot support connected to and extending up from said base member proximate said rear end; and a locking means, operatively connected to said pad member, for locking said pad member in any one of said plurality of positions.

5. An apparatus according to claim 4, wherein said first elevation foot support and said pad member are spatially positioned relative to one another such that when the person's pelvis is stabilized relative to said pad member and said pad member is pivoted to and locked in a particular operable position, said first elevation foot support provides support for the feet of the person performing McKenzie extension exercises.

6. An apparatus according to claim 5, further comprising a second elevation foot support extending up from said base member proximate said rear end, wherein said second elevation foot support and said pad member are spatially positioned relative to one another such that when the pelvis of the person is stabilized relative to said pad member and said pad member is pivoted to and locked in another particular operable position, said second elevation foot support provides support for the feet of the person performing Williams flexion exercises, and wherein said second elevation foot support and said pad member are spatially positioned relative to one another such that when the pelvis of the person is stabilized relative to said pad member and said pad member is pivoted to and locked in yet another particular operable position, said second elevation foot support provides support for the feet of the person receiving inversion therapy.

7. An apparatus of a type on which a person receives back therapy, comprising:

(a) a rigid frame; including:

(i) a substantially planar base member, extending from a front end to a rear end and designed to rest upon a floor surface;

(ii) a substantially planar intermediate upright member, extending up from said base member intermediate said front end and said rear end; and (iii) a substantially planar end upright member, extending up from said base member proximate said rear end, wherein said end upright member is substantially perpendicular to said base member and substantially parallel to said intermediate upright member, and said end upright member includes first and second foot support members parallel to planes containing said intermediate upright member and said base member;

(b) a pad member, pivotally mounted to said intermediate upright member, wherein said pad member pivots among a plurality of positions, defining a plane of pivoting perpendicular to said intermediate upright member and to said base member;

(c) a pelvic stabilization belt, secured relative to said pad member, for stabilizing the person's pelvis relative to said pad member; and (d) a locking mechanism, operatively connected to said pad member, for locking said pad member in any one of said plurality of positions.

8. An apparatus according to claim 7 wherein said pad member has a contoured, person engaging surface characterized by a substantially rounded first segment joined to a substantially flat second segment joined to a substantially flat third segment, with said first segment facing away from said second segment, and said second segment facing away from said third segment.

* * * * *